US012357065B2

(12) United States Patent
Browne

(10) Patent No.: US 12,357,065 B2
(45) Date of Patent: Jul. 15, 2025

(54) UMBRELLA WITH SLIDING MAST AND RELATED METHODS

(71) Applicant: ATLeisure, LLC, Atlanta, GA (US)

(72) Inventor: William Martin Browne, Atlanta, GA (US)

(73) Assignee: ATLEISURE, LLC, Atlanta, GA (US)

( * ) Notice: Subject to any disclaimer, the term of this patent is extended or adjusted under 35 U.S.C. 154(b) by 113 days.

(21) Appl. No.: 18/186,375

(22) Filed: Mar. 20, 2023

(65) Prior Publication Data

US 2024/0180304 A1 Jun. 6, 2024

Related U.S. Application Data

(60) Provisional application No. 63/385,883, filed on Dec. 2, 2022.

(51) Int. Cl.

| | |
|---|---|
| ***A45B 19/04*** | (2006.01) |
| ***A45B 17/00*** | (2006.01) |
| ***A45B 19/10*** | (2006.01) |
| ***A45B 25/08*** | (2006.01) |
| *A45B 23/00* | (2006.01) |
| *A45B 25/14* | (2006.01) |

(52) U.S. Cl.

CPC ..... *A45B 17/00* (2013.01); *A45B 19/04* (2013.01); *A45B 19/10* (2013.01); *A45B 25/08* (2013.01); *A45B 2023/0012* (2013.01); *A45B 2025/146* (2013.01)

(58) Field of Classification Search

CPC ..... A45B 19/04; A45B 2023/0012; A45B 2009/007

See application file for complete search history.

(56) References Cited

U.S. PATENT DOCUMENTS

| | | | | |
|---|---|---|---|---|
| 1,902,774 A | | 3/1933 | Hans | |
| 2,088,127 A | | 7/1937 | Hermann | |
| 3,411,519 A | | 11/1968 | Heinz | |
| 3,496,950 A | | 2/1970 | Heinz et al. | |
| 4,132,236 A | * | 1/1979 | Petersen | A45B 17/00 403/90 |
| 4,697,606 A | * | 10/1987 | Ma | A45B 25/14 135/909 |
| 5,287,869 A | | 2/1994 | Wu | |
| 5,387,048 A | | 2/1995 | Kuo | |
| 5,433,552 A | * | 7/1995 | Thyu | A47C 3/34 403/322.4 |
| 5,711,333 A | * | 1/1998 | Vanderminden, Sr. | A45B 17/00 135/20.1 |

(Continued)

*Primary Examiner* — Noah Chandler Hawk

(74) *Attorney, Agent, or Firm* — Allen, Dyer, Doppelt + Gilchrist, PA

(57) ABSTRACT

An umbrella includes a canopy configured to switch between an open position and a closed position, and a mast coupled to the canopy and having an upper portion with an upper tubular housing, and a track carried on an outer surface of the upper tubular housing and extending longitudinally. The track includes interweaved recesses and ridges. The mast also includes a lower portion slidingly receiving the upper portion and having a lower tubular housing, and a locking device carried on an outer surface of the lower tubular housing and extending through the lower tubular housing to interface with the track of the upper portion to lock the lower portion and the upper portion together.

20 Claims, 8 Drawing Sheets

(56) References Cited

U.S. PATENT DOCUMENTS

| | | | | |
|---|---|---|---|---|
| 6,017,009 | A * | 1/2000 | Swartz | A47B 57/10 248/245 |
| 6,302,124 | B1 | 10/2001 | DeMarco | |
| 6,311,705 | B1 * | 11/2001 | Ma | A45B 17/00 248/514 |
| 6,330,887 | B1 | 12/2001 | Chen | |
| 6,371,686 | B1 | 4/2002 | Wu | |
| 6,418,949 | B1 | 7/2002 | Lin et al. | |
| 6,698,962 | B2 * | 3/2004 | Wang | F16B 7/1418 403/109.1 |
| 6,869,243 | B1 | 3/2005 | Teeter | |
| 6,871,659 | B2 * | 3/2005 | Tung | A45B 19/04 135/20.3 |
| 7,665,477 | B1 * | 2/2010 | Hathaway | A45B 25/006 135/20.1 |
| 8,113,223 | B2 | 2/2012 | Wang et al. | |
| 9,057,475 | B1 | 6/2015 | Macfarlane | |
| 9,364,058 | B1 | 6/2016 | Hsieh | |
| 11,412,821 | B2 | 8/2022 | Wang et al. | |
| 2002/0151414 | A1 | 10/2002 | Baker | |
| 2003/0156923 | A1 * | 8/2003 | Winkler | F16B 7/105 411/552 |
| 2004/0226591 | A1 | 11/2004 | You | |
| 2007/0261728 | A1 * | 11/2007 | Lin | A45B 17/00 135/20.1 |
| 2021/0015223 | A1 | 1/2021 | McWhorter | |

* cited by examiner

UMBRELLA WITH SLIDING MAST AND RELATED METHODS

RELATED APPLICATION

This application is based upon prior filed copending Application No. 63/385,883 filed Dec. 2, 2022, the entire subject matter of which is incorporated herein by reference in its entirety.

TECHNICAL FIELD

The present disclosure relates to the field of outdoor accessories, and, more particularly, to an umbrella and related methods.

BACKGROUND

Large patio-style umbrellas are useful on patios, decks, pools, beaches, and in other outdoor settings for providing protection from the sun and allowing users a convenient way to enjoy shade while participating in outdoor activities. Typically, the umbrella comprises a mast extending from a base, and a canopy coupled to the mast opposite to the base. Due to the size of the canopy, there are some application where it can be useful to adjust the height of the mast, for example, when the umbrella is deployed within a screen enclosure.

SUMMARY

Generally, an umbrella comprises a canopy configured to switch between an open position and a closed position, and a mast coupled to the canopy and comprising an upper portion comprising an upper tubular housing, and a track carried on an outer surface of the upper tubular housing and extending longitudinally. The track comprises interweaved recesses and ridges. The mast also includes a lower portion slidingly receiving the upper portion and comprising a lower tubular housing, and a locking device carried on an outer surface of the lower tubular housing and extending through the lower tubular housing to interface with the track of the upper portion to lock the lower portion and the upper portion together.

In particular, the locking device may comprise a sleeve carried on the outer surface of the lower tubular housing, and a mount extending outward from the sleeve. The mount may have an outer threaded surface. The mount may define a passageway aligned with the track, and the locking device may include a pin received by the passageway and to interface with the track. In some embodiments, the pin may comprise a peripheral flange, and the mount may comprise an inner rim surrounding the passageway and to retain the pin within the passageway.

Also, the pin may comprise a keyed distal end to be received by the interweaved recesses and ridges of the track. The locking device may comprise a cap having an inner threaded surface to engage with the outer threaded surface of the mount. The cap may comprise a raised peripheral rim defining the inner threaded surface, and a medial protrusion within the raised peripheral rim and to abut the pin.

The pin may define a first fastener receiving passageway opposite the track, and the medial protrusion may define a second fastener receiving passageway aligned with the first fastener receiving passageway. The locking device may comprise a fastener extending through the first fastener receiving passageway and the second fastener receiving passageway for coupling the cap and the pin together. The upper portion may comprise a winding device coupled to the upper tubular housing and configured cause the canopy to switch from the closed position to the open position.

Another aspect is directed to a method of making an umbrella. The method includes providing a canopy configured to switch between an open position and a closed position, and coupling a mast to the canopy. The mast comprises an upper portion comprising an upper tubular housing, and a track carried on an outer surface of the upper tubular housing and extending longitudinally. The track comprises interweaved recesses and ridges. The mast also includes a lower portion slidingly receiving the upper portion and comprising a lower tubular housing, and a locking device carried on an outer surface of the lower tubular housing and extending through the lower tubular housing to interface with the track of the upper portion to lock the lower portion and the upper portion together.

DETAILED DESCRIPTION

Figure 1:
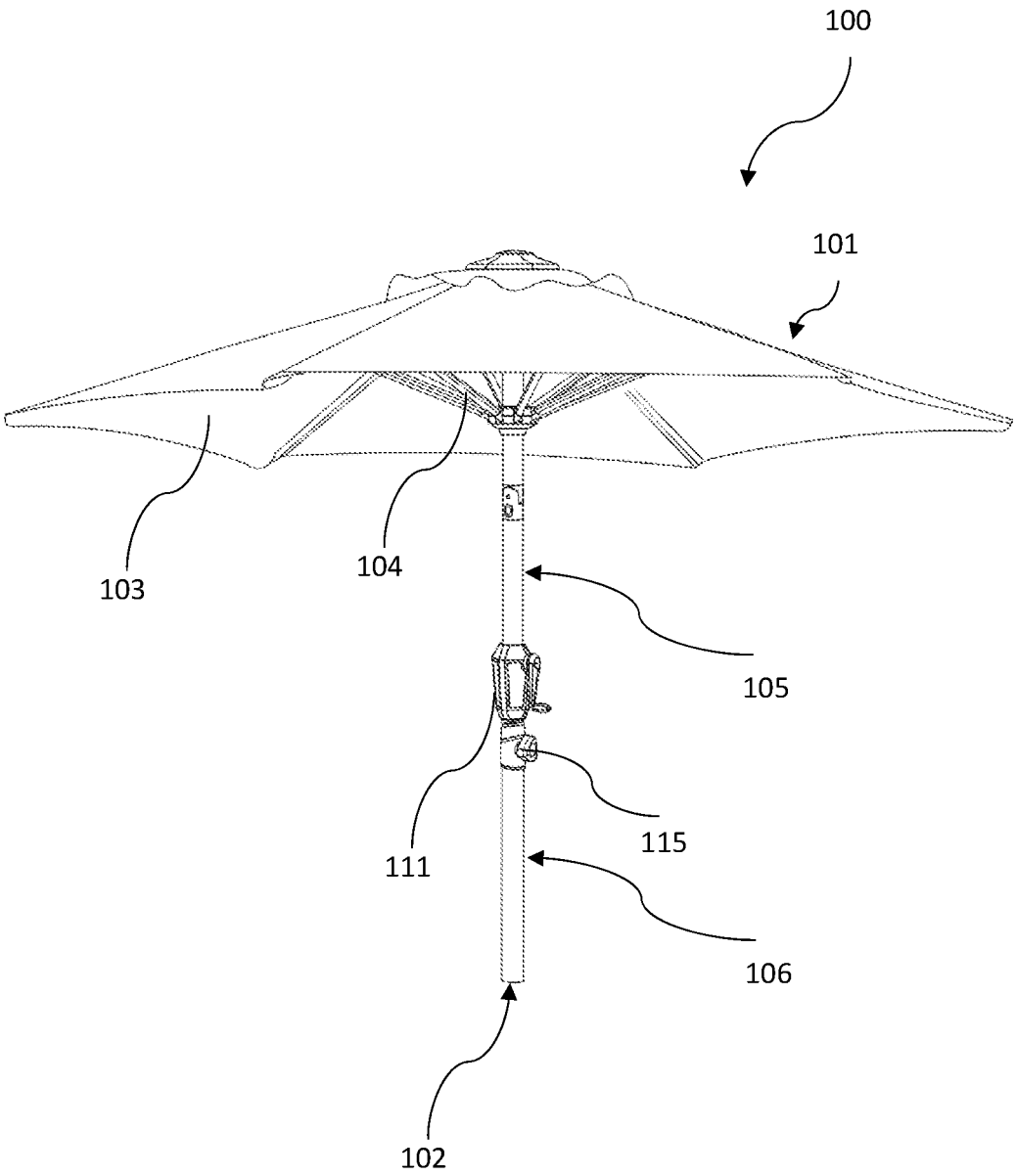
FIG. 1 is a perspective view of an umbrella in an open position, according to a first embodiment of the present disclosure.
Figure 2:
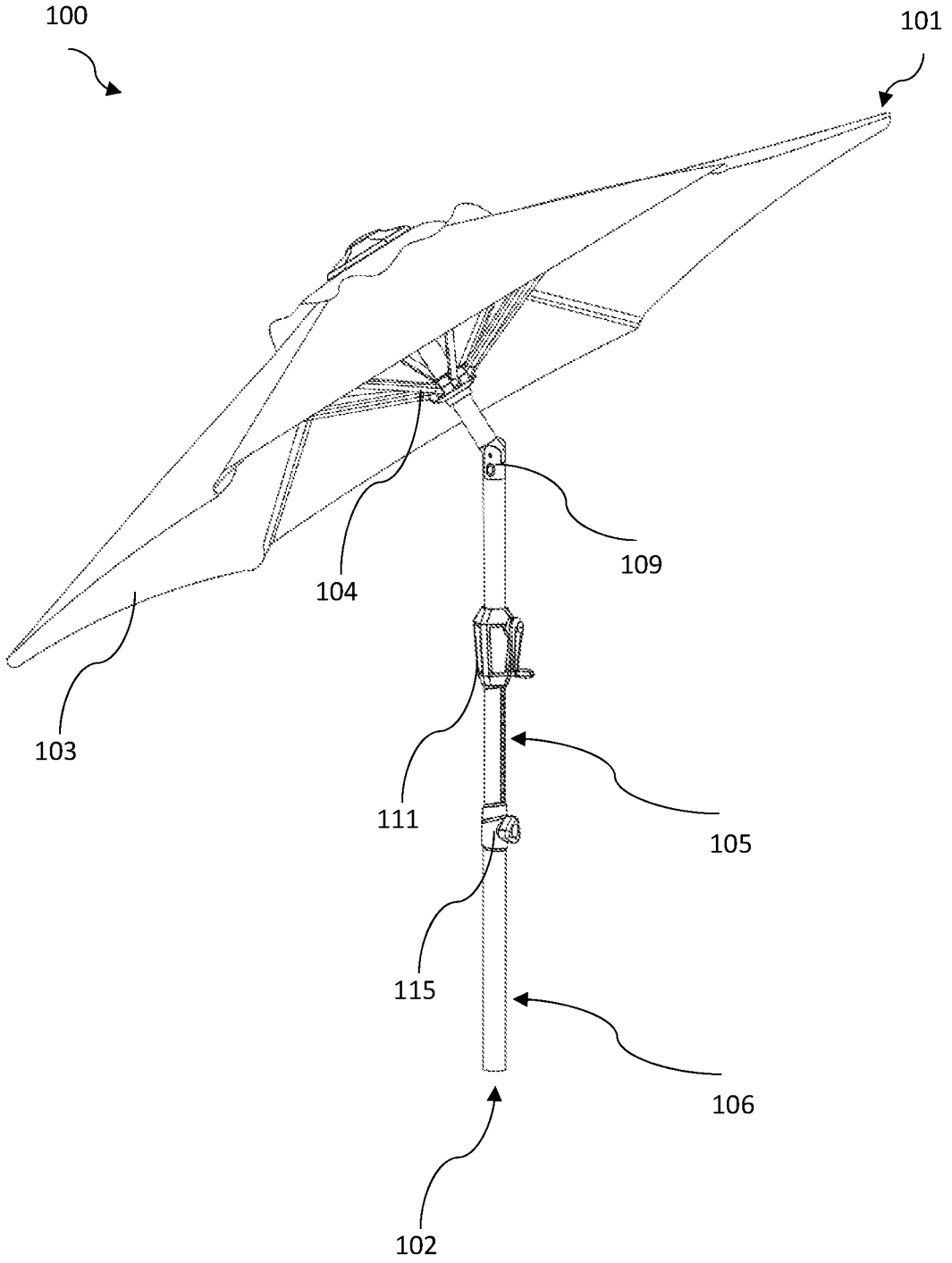
FIG. 2 is a perspective view of the umbrella from FIG. 1 in a tilted position.
Figure 3:
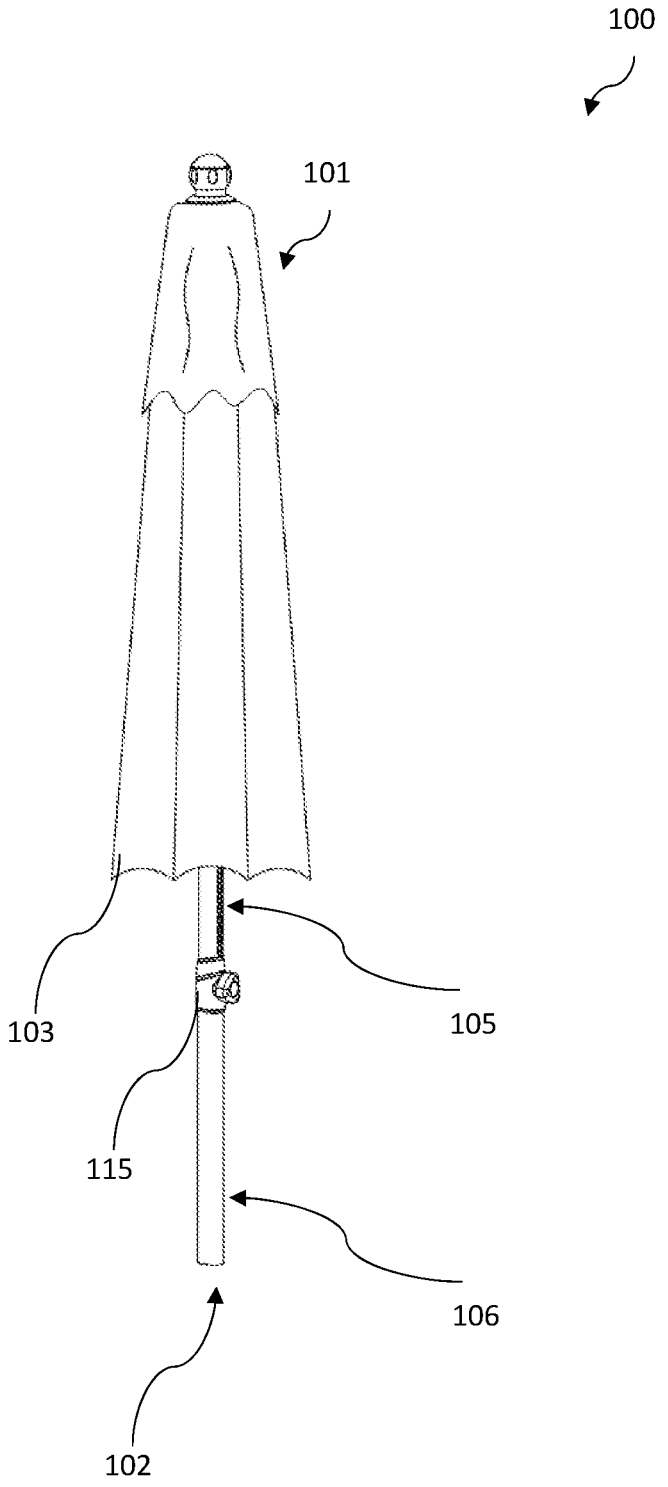
FIG. 3 is a perspective view of the umbrella from FIG. 1 in a closed position.
Figure 4:
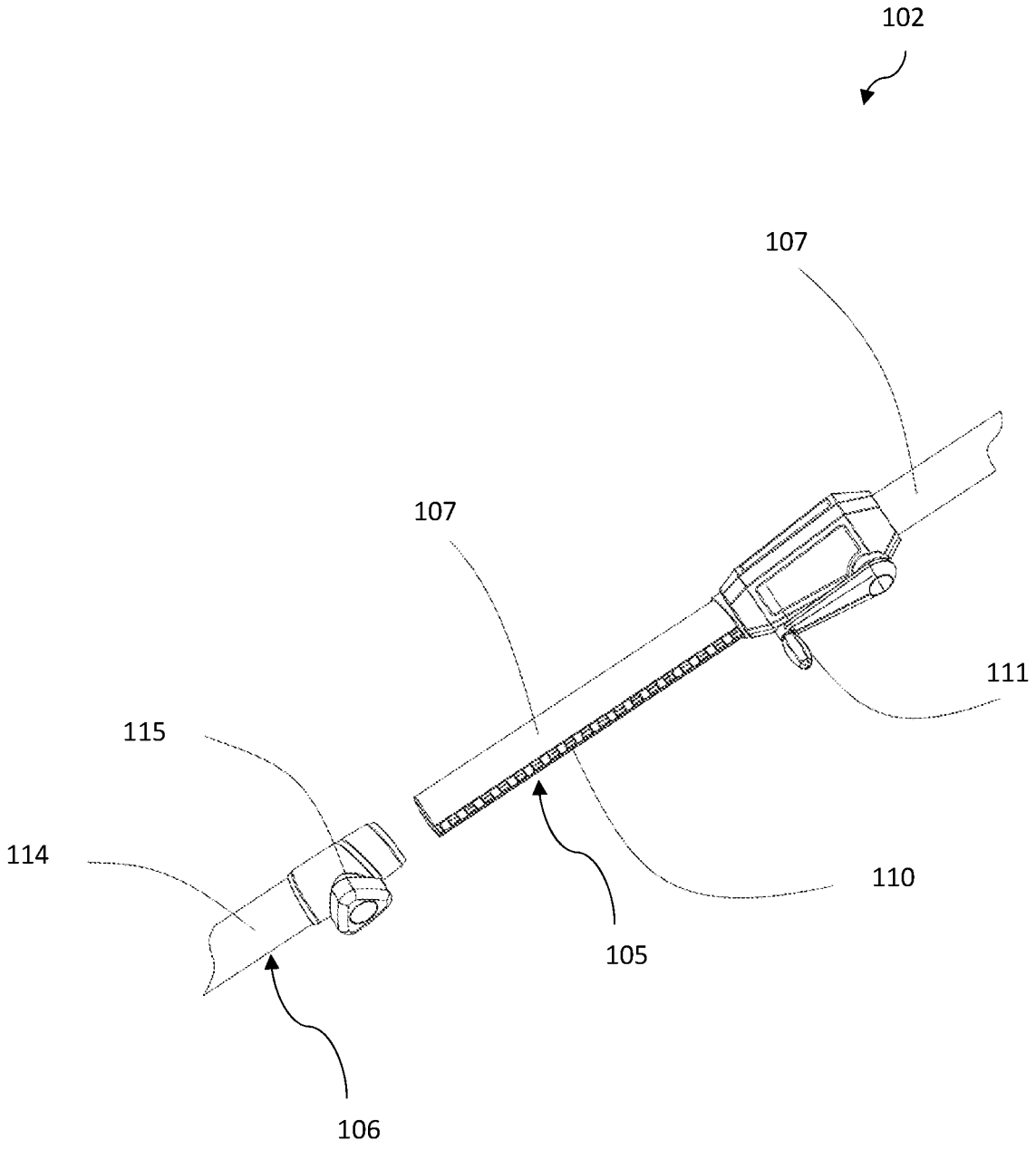
FIG. 4 is a perspective view of the upper portion and the lower portion from the umbrella from FIG. 1 in spaced apart relation.
Figure 5:
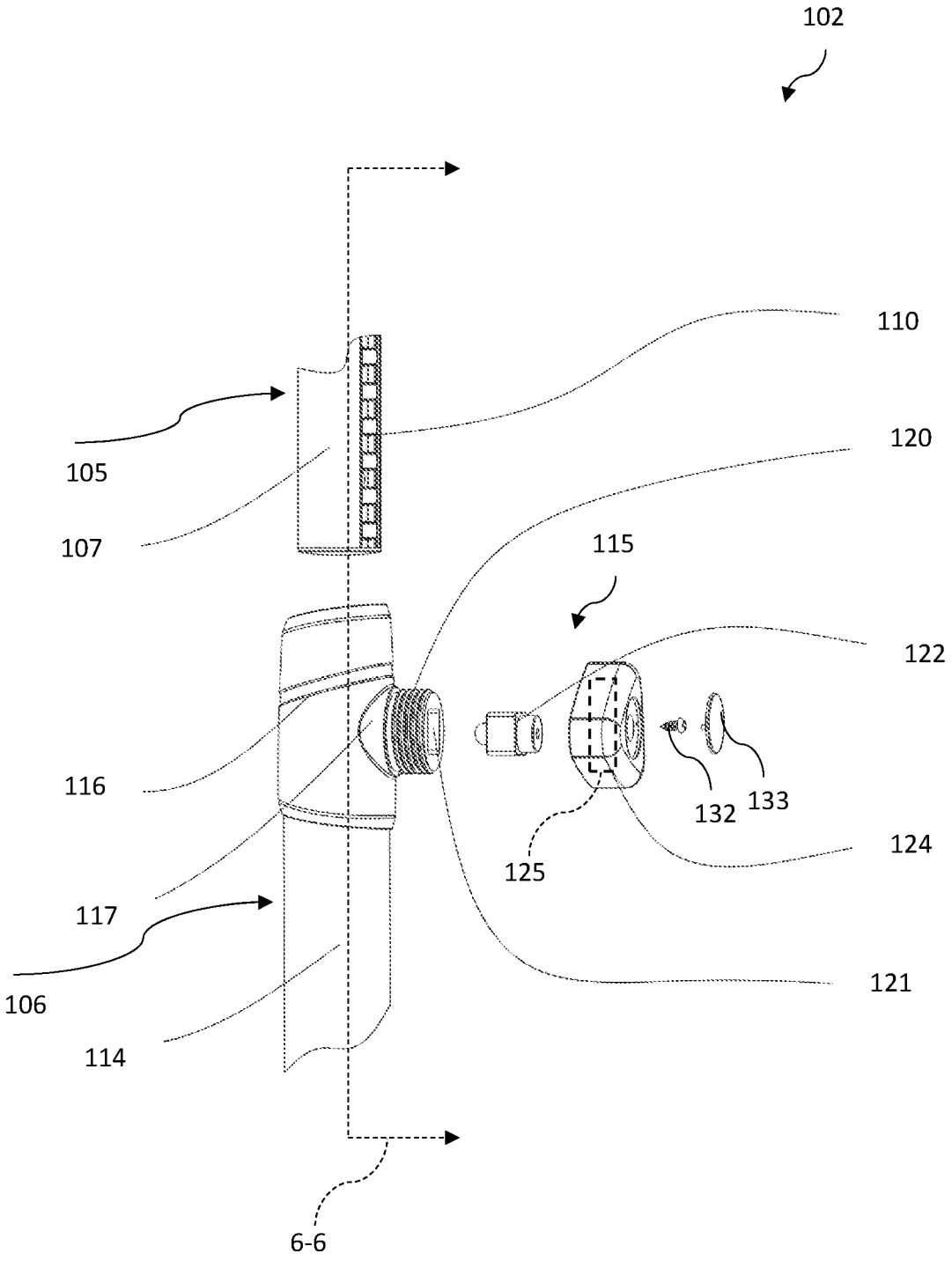
FIG. 5 is an exploded view of the upper portion and the lower portion from the umbrella from FIG. 1 in spaced apart relation.

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout, and base 100 reference numerals are used to indicate similar elements in alternative embodiments.

Referring initially to FIGS. 1-7, an umbrella 100 according to the present disclosure is now described. The umbrella 100 illustratively includes a canopy 101 configured to switch between an open position (FIGS. 1-2) and a closed position (FIG. 3), and a mast 102 coupled to an uppermost portion of the canopy. The canopy 101 includes a fabric shell 103, and a structure 104 supporting the fabric shell. As will be appreciated, the structure 104 comprises a plurality of support arms, and a collar coupled to the plurality of support arms and slidingly positioned on the mast 102.

The mast 102 illustratively comprises an upper portion 105, and a lower portion 106 slidingly receiving the upper portion. In the illustrated embodiment, both the upper portion 105 and the lower portion 106 each comprises a tube having a circle-shaped cross-section, the lower portion having a diameter greater than that of the upper portion. In short, the upper portion 105 and the lower portion 106 are telescoping. In other embodiments, the upper portion 105 and the lower portion 106 may have different cross-section shapes, such as a rectangle-shaped cross-section. Also, the mast 102 may comprise a metallic material, such as aluminum, but may comprise one or more metals in some embodiments. Indeed, any rigid material with sufficient mechanical strength may be used.

The upper portion 105 comprises an upper tubular housing 107, and a track 110 carried on an outer surface of the upper tubular housing and extending longitudinally. The upper portion 105 illustratively comprises a pivoting device 109 configured to cause the canopy 101 to switch between the tilted position (FIG. 2) and the untilted position (FIGS. 1 & 3), and a winding device 111 coupled to the upper tubular housing 107 and configured cause the canopy to switch from the closed position to the open position. For example, in some embodiments, the winding device 111 comprises a hub, a line wound around the hub and extending through the upper portion 105 and to the canopy, and a handle (e.g., illustrated crank, embedded finger recesses) coupled to the hub.

Figure 6:
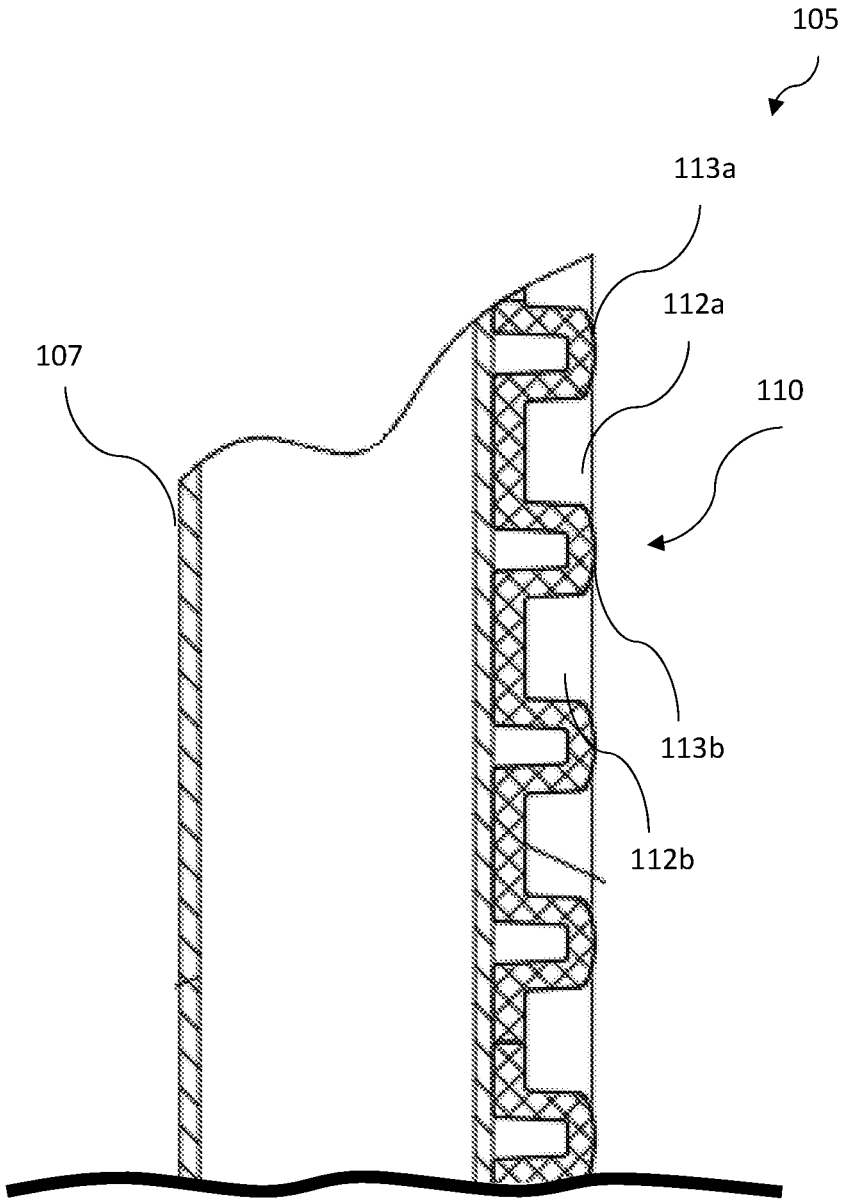
FIG. 6 is a cross-sectional view of the upper portion along line 6-6 from the umbrella from FIG. 1.
Figure 7:
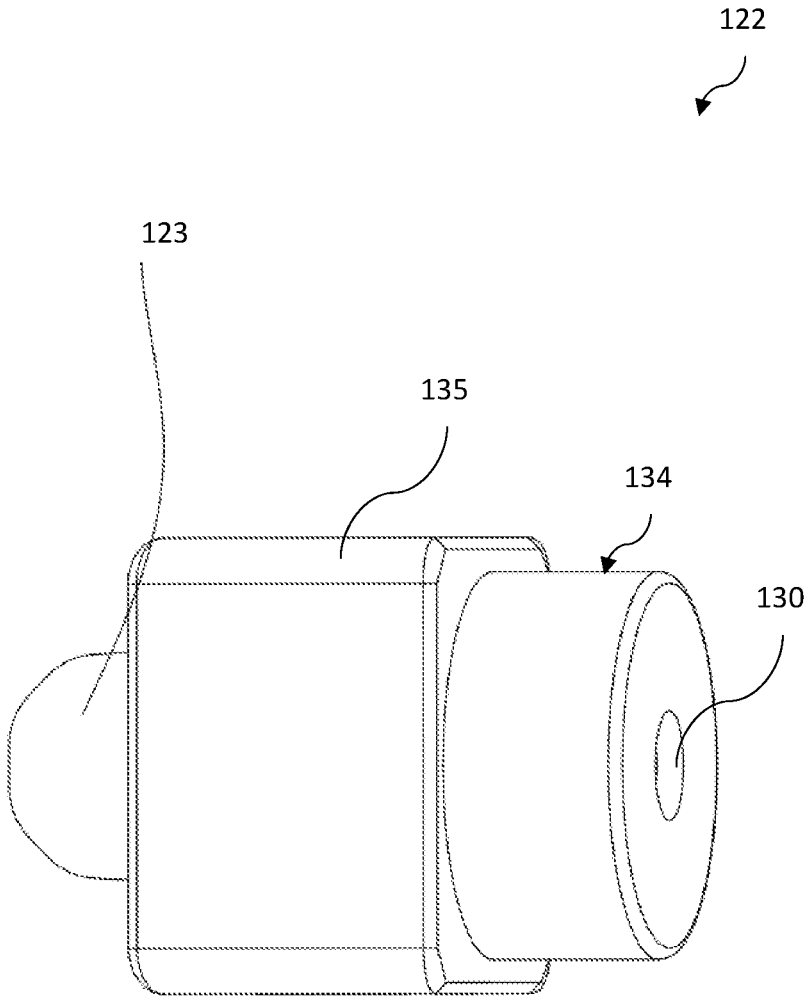
FIG. 7 is a perspective view of the pin from the umbrella from FIG. 1.

As perhaps best seen in FIG. 6, the track 110 illustratively includes interweaved recesses 112*a*-112*b* and ridges 113*a*-113*b*. In the illustrated example embodiment, the interweaved recesses 112*a*-112*b* and ridges 113*a*-113*b* are substantially rectangle-shaped, but in other embodiments, they may have rounded shapes or triangle-shaped recesses and ridges.

The lower portion 106 comprises a lower tubular housing 114, and a locking device 115 carried on an outer surface of the lower tubular housing and extending through an opening 208 (FIG. 8) in the lower tubular housing to interface with the track 110 of the upper portion 105 to lock the lower portion and the upper portion together. In particular, the locking device 115 illustratively includes a sleeve 116 carried on the outer surface of the lower tubular housing 114, and a mount 117 extending outward from the sleeve. The mount 117 has an outer threaded surface 120, and is illustratively circle-shaped. In some embodiments, the sleeve 116 and the mount 117 may be integrally formed.

The mount 117 defines a passageway 121 (illustratively rectangle-shaped) aligned with the track 110. More specifically, when the upper portion 105 is received by the lower portion 106, the track 110 is visible via the passageway 121. The locking device 115 illustratively includes a pin 122 received by the passageway 121 and to interface with the track 110. The pin comprises a keyed distal end 123 to be received by the interweaved recesses 112*a*-112*b* and ridges 113*a*-113*b* of the track 110.

The locking device 115 illustratively comprises a cap 124 having an inner threaded surface 125 to engage with the outer threaded surface 120 of the mount 117. The cap 124 comprises a raised peripheral rim 226 (FIG. 8) defining the inner threaded surface 125, and a medial protrusion 227 (FIG. 8) within the raised peripheral rim and to abut the pin 122.

The pin 122 illustratively includes a proximal end 134 defining a first fastener receiving passageway 130 opposite the track 110, and the medial protrusion 227 defines a second fastener receiving passageway 231 (FIG. 8) aligned with the first fastener receiving passageway. The proximal end 134 is illustratively cylinder-shaped, but may take on other shapes in other embodiments. The pin 122 illustratively comprises a medial portion 135 between the proximal end 134 and the keyed distal end 123. The medial portion 135 has a greater thickness than the proximal end 134 and the keyed distal end 123, and has rounded corners. Also, the medial portion 135 is illustratively rectangle-shaped in cross-section to fit into the passageway 121.

The locking device 115 illustratively includes a fastener 132 (e.g., threaded screw) extending through the first fastener receiving passageway 130 and the second fastener receiving passageway 231 for coupling the cap 124 and the pin 122 together, and a cover 133 configured to protect the fastener and fitting into an opening of the second fastener receiving passageway 231.

As will be appreciated, the mast 102 of the umbrella 100 may be configured to have a desired height by sliding the upper portion 105 into the lower portion 106. When the user wants to adjust height, the user unscrews the cap 124 from the mount 117, which releases the pin 122 from the track 110 (i.e. moving the keyed distal end 123 outward and free of the interweaved recesses 112*a*-112*b* and ridges 113*a*-113*b* of the track 110). When the desired height has been reached, the user then screws the cap 124 onto the mount 117, which positions the pin 122 into the track 110 (i.e. moving the keyed distal end 123 inward and into the interweaved recesses 112*a*-112*b* and ridges 113*a*-113*b* of the track 110).

Another aspect is directed to a method of making an umbrella 100. The method includes providing a canopy 101 configured to switch between an open position and a closed position, and coupling a mast 102 to the canopy. The mast 102 comprises an upper portion 105 comprising an upper tubular housing 107, and a track 110 carried on an outer surface of the upper tubular housing and extending longitudinally. The track 110 comprises interweaved recesses 112*a*-112*b* and ridges 113*a*-113*b*. The mast 102 also includes a lower portion 106 slidingly receiving the upper portion 105 and comprising a lower tubular housing 114, and a locking device 115 carried on an outer surface of the lower tubular housing and extending through the lower tubular housing to interface with the track 110 of the upper portion 105 to lock the lower portion and the upper portion together.

Figure 8:
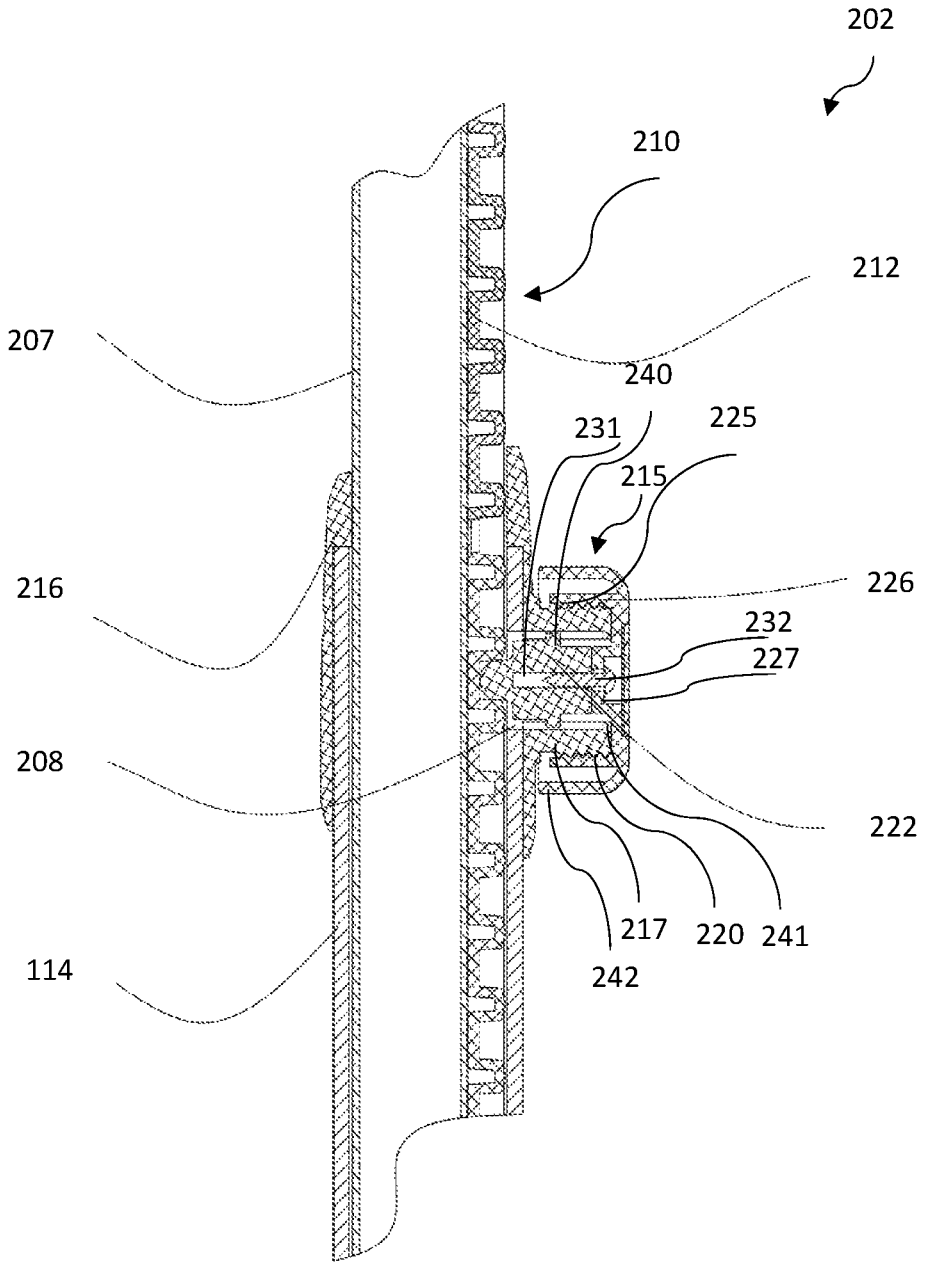
FIG. 8 is a cross-sectional view of the upper portion and the lower portion along line 6-6 from an umbrella, according to a second embodiment of the present disclosure.

Referring now additionally to FIG. 8, another embodiment of the umbrella 200 is now described. In this embodiment of the umbrella 200, those elements already discussed above with respect to FIGS. 1-7 are incremented by 100 and most require no further discussion herein. This embodiment differs from the previous embodiment in that this umbrella 200 illustratively includes the pin 222 having a peripheral flange 240. The mount 217 illustratively comprises an inner rim 241 surrounding the passageway 221 and to retain the pin 222 and the cap 224 coupled thereto within the passageway when the cap is unscrewed from the mount 217, which releases the pin 222 from the track 210.

The cap 224 illustratively includes the raised peripheral rim 226, and an outer rim 242 radially spaced apart from the raised peripheral rim and defining an annular space therebetween. The outer rim 242 supports the torque from the user threading the cap 224 onto the mount 217.

Other features relating to umbrellas are disclosed in U.S. Pat. Nos. 7,604,015; 8,104,492; 9,470,413; 7,882,846; 9,504,298; 7,533,679; 9,622,569; 5,937,882; 6,889,953; and 9,655,417, all incorporated herein by reference in their entirety.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

The invention claimed is:

1. An umbrella comprising:

a canopy configured to switch between an open position and a closed position; and a mast coupled to the canopy and comprising an upper portion comprising an upper tubular housing, and a track carried on an outer surface of the upper tubular housing and extending longitudinally, the track comprising interweaved recesses and ridges, and a lower portion slidingly receiving the upper portion and comprising a lower tubular housing, and a locking device carried on an outer surface of the lower tubular housing and comprising a mount extending outward from the lower tubular housing and defining a passageway therein and aligned with the track, the mount having an outer threaded surface, a pin received by the passageway and extending through the lower tubular housing to interface with the track of the upper portion, and a cap having an inner threaded surface to engage with the outer threaded surface of the mount and to cause the pin to lock the lower portion and the upper portion together.

2. The umbrella of claim 1 wherein the locking device comprises a sleeve carried on the outer surface of the lower tubular housing.

3. The umbrella of claim 1 wherein the pin comprises a peripheral flange; and wherein the mount comprises an inner rim surrounding the passageway and to retain the pin within the passageway.

4. The umbrella of claim 1 wherein the pin comprises a keyed distal end to be received by the interweaved recesses and ridges of the track.

5. The umbrella of claim 4 wherein the pin comprises a proximal portion, and a medial portion between the keyed distal portion and the proximal portion, the medial portion having a width greater than that of the distal portion and the proximal portion.

6. The umbrella of claim 1 wherein the cap comprises a raised peripheral rim defining the inner threaded surface, and a medial protrusion within the raised peripheral rim and to abut the pin.

7. The umbrella of claim 6 wherein the pin defines a first fastener receiving passageway opposite the track; wherein the medial protrusion defines a second fastener receiving passageway aligned with the first fastener receiving passageway; and wherein the locking device comprises a fastener extending through the first fastener receiving passageway and the second fastener receiving passageway for coupling the cap and the pin together.

8. The umbrella of claim 1 wherein the upper portion comprises a winding device coupled to the upper tubular housing and configured cause the canopy to switch from the closed position to the open position.

9. The umbrella of claim 1 wherein the upper portion comprises a pivoting device between the locking device and the canopy and configured to cause the canopy to switch between a tilted position and an untilted position.

10. An umbrella comprising:

a canopy configured to switch between an open position and a closed position; and a mast coupled to the canopy and comprising an upper portion comprising an upper tubular housing, a track carried on an outer surface of the upper tubular housing and extending longitudinally, the track comprising interweaved recesses and ridges, and a winding device coupled to the upper tubular housing and configured to cause the canopy to switch from the closed position to the open position, and a lower portion slidingly receiving the upper portion and comprising a lower tubular housing, and a locking device comprising a sleeve carried on an outer surface of the lower tubular housing, a mount extending outward from the sleeve, the mount having an outer threaded surface and defining a passageway aligned with the track, and a pin received by the passageway and extending through the lower tubular housing to interface with the track of the upper portion, and a cap having an inner threaded surface to engage with the outer threaded surface of the mount and to cause the pin to lock the lower portion and the upper portion together.

11. The umbrella of claim 10 wherein the pin comprises a peripheral flange; and wherein the mount comprises an inner rim surrounding the passageway and to retain the pin within the passageway.

12. The umbrella of claim 10 wherein the pin comprises a keyed distal end to be received by the interweaved recesses and ridges of the track.

13. The umbrella of claim 12 wherein the pin comprises a proximal portion, and a medial portion between the keyed distal portion and the proximal portion, the medial portion having a width greater than that of the distal portion and the proximal portion.

14. The umbrella of claim 10 wherein the cap comprises a raised peripheral rim defining the inner threaded surface, and a medial protrusion within the raised peripheral rim and to abut the pin.

15. The umbrella of claim 14 wherein the pin defines a first fastener receiving passageway opposite the track; wherein the medial protrusion defines a second fastener receiving passageway aligned with the first fastener receiving passageway; and wherein the locking device comprises a fastener extending through the first fastener receiving passageway and the second fastener receiving passageway for coupling the cap and the pin together.

16. The umbrella of claim 10 wherein the upper portion comprises a pivoting device between the locking device and the canopy and configured to cause the canopy to switch between a tilted position and an untilted position.

17. A method of making an umbrella comprising:

providing a canopy configured to switch between an open position and a closed position; and coupling a mast to the canopy, the mast comprising an upper portion comprising an upper tubular housing, and a track carried on an outer surface of the upper tubular housing and extending longitudinally, the track comprising interweaved recesses and ridges, and a lower portion slidingly receiving the upper portion and comprising a lower tubular housing, and a locking device carried on an outer surface of the lower tubular housing and comprising a mount extending outward from the lower tubular housing and defining a passageway therein and aligned with the track, the mount having an outer threaded surface, a pin received by the passageway and extending through the lower tubular housing to interface with the track of the upper portion, and a cap having an inner threaded surface to engage with the outer threaded surface of the mount and to cause the pin to lock the lower portion and the upper portion together.

18. The method of claim 17 wherein the locking device comprises a sleeve carried on the outer surface of the lower tubular housing.

19. The method of claim 17 wherein the pin comprises a peripheral flange; and wherein the mount comprises an inner rim surrounding the passageway and to retain the pin within the passageway.

20. The method of claim 17 wherein the pin comprises a keyed distal end to be received by the interweaved recesses and ridges of the track.

* * * * *